US007699496B2

(12) United States Patent
Miyazono

(10) Patent No.: US 7,699,496 B2
(45) Date of Patent: Apr. 20, 2010

(54) FLUORESCENT TUBE ATTACHING STRUCTURE

(75) Inventor: Katsunori Miyazono, Osaka (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 11/500,925

(22) Filed: Aug. 9, 2006

(65) Prior Publication Data

US 2007/0037427 A1 Feb. 15, 2007

(30) Foreign Application Priority Data

Aug. 12, 2005 (JP) ..... 2005-234795

(51) Int. Cl.
*F21V 21/00* (2006.01)
*F21S 4/00* (2006.01)
*H01R 33/02* (2006.01)
*H01R 13/15* (2006.01)

(52) U.S. Cl. ..... 362/217.01; 362/219; 362/221; 362/222; 362/223; 362/225; 362/249.01; 362/615; 362/616; 362/29; 439/232; 439/233; 439/239; 439/242; 439/259; 439/260; 439/263; 439/698

(58) Field of Classification Search ..... 362/217, 362/219, 221–223, 29, 615–616, 225, 249.01; 439/227–244, 259–260, 263, 698
See application file for complete search history.

(56) References Cited

U.S. PATENT DOCUMENTS 1,890,680 A 12/1932 Harase
2,441,456 A 5/1948 Thayer
2,729,799 A 1/1956 Pistey
3,851,295 A * 11/1974 Geier ..... 439/232
4,795,357 A 1/1989 Kosmol et al.

(Continued)

FOREIGN PATENT DOCUMENTS

DE 3537 601 A1 4/1987

(Continued)

OTHER PUBLICATIONS

European Search Report, Ref. P026825EP PP, App No. 06254189. 1-2214, J.S.T.Mfg. Co., Ltd. Mar. 9, 2007 (4 pages).

(Continued)

*Primary Examiner*—Sharon E Payne
*Assistant Examiner*—Sean P Gramling
(74) *Attorney, Agent, or Firm*—Rader, Fishman & Grauer, PLLC

(57) ABSTRACT

A structure for attaching a fluorescent tube includes a base, a holder supported by the base, and a pair of contacts. The holder holds an intermediate portion of the fluorescent tube while restraining the fluorescent tube from moving in a radial direction. To the pair of contacts, terminals of a pair of end portions of the fluorescent tube are respectively attachable in an attaching direction corresponding to the radial direction of the fluorescent tube. Each contact includes a pair of elastic pieces facing each other. The pair of elastic pieces have a pair of straight portions extending substantially straight along the attaching direction and facing each other. On the pair of straight portions, a pair of contact portions for clamping the corresponding terminal of the fluorescent tube therebetween are formed.

12 Claims, 15 Drawing Sheets

U.S. PATENT DOCUMENTS

| | | | | |
|---|---|---|---|---|
| 5,261,831 | A | 11/1993 | Vendel et al. | |
| 5,886,758 | A | 3/1999 | Ibaraki | |
| 6,869,300 | B2 * | 3/2005 | Lefki et al. | 439/242 |
| 7,255,470 | B2 * | 8/2007 | Lee et al. | 362/614 |
| 7,265,500 | B2 * | 9/2007 | Ono et al. | 315/291 |
| 2003/0112626 | A1 * | 6/2003 | Yoo et al. | 362/225 |
| 2006/0279957 | A1 * | 12/2006 | Kwon et al. | 362/378 |

FOREIGN PATENT DOCUMENTS

| | | | |
|---|---|---|---|
| EP | 1 753 088 | A3 | 2/2007 |
| JP | 58-164191 | | 9/1983 |
| JP | 62-014684 | U | 1/1987 |
| JP | 63-155587 | | 6/1988 |
| JP | 63-225482 | A | 9/1988 |
| JP | 08-008009 | A | 1/1996 |
| JP | 10-289610 | A | 10/1998 |
| JP | 2001-043715 | A | 2/2001 |
| JP | 2001-076529 | A | 3/2001 |
| JP | 2001-250605 | A | 9/2001 |
| JP | 2002-367422 | A | 12/2002 |
| JP | 2003-279984 | A | 10/2003 |
| JP | 2004-259645 | | 9/2004 |
| JP | 2004-259645 | A | 9/2004 |
| JP | 2005-158585 | A | 6/2005 |
| JP | 2005-259370 | A | 9/2005 |
| JP | 2006-244749 | A | 9/2006 |
| JP | 2006-344602 | A | 12/2006 |
| WO | WO-03/007434 | A1 | 1/2003 |
| WO | WO-2004/001282 | A2 | 12/2003 |

OTHER PUBLICATIONS

JPO Office Action, for JP Application No. 2007-072782, dated Mar. 11, 2008.

JPO Office Action (Transmission No. 108752-1) for Application No. 2007-072783, Oct. 2, 2007 (2 pages).

JPO Office Action (Transmission No. 108751-2) for Application No. 2007-072783, Oct. 2, 2007 (2 pages).

JPO Office Action with Notification, App No. 2007-072782, Ref. No. 108751-2, Dispatch No. 175814, Dispatch Date: Nov. 20, 2007 (14 pages).

JPO Office Action with Notification, App. No. 2007-072783, Ref. No. 108752-1, Dispatch No. 175822, Dispatch Date Nov. 20, 2007 (11 pages).

Korean P. O. Decision to Grant a Patent, App. No. 10-2006-0076202, Jan. 22, 2009 (2 pages).

Korean P. O. Decision to Grant a Patent, App. No. 10-2007-0038041, Jan. 28, 2009 (2 pages).

Extended European Search Report, App. No. 06254196.6-1231, Oct. 12, 2009 (8 pages).

* cited by examiner

FLUORESCENT TUBE ATTACHING STRUCTURE

BACKGROUND OF THE INVENTION

1. Field of the Invention

The present invention relates to a attaching structure for a long fluorescent tube.

2. Description of Related Arts

For example, as connecting structures for terminals of fluorescent tubes such as cold cathode fluorescent tubes to be used as a backlight of a liquid crystal display type television or monitor, the following documents 1 and 2 have been proposed.

Document 1: Japanese Unexamined Patent Publication No. 2001-250605 (Date of publication: Sep. 14, 2001)

Document 2: Japanese Unexamined Patent Publication No. 2004-259645 (Date of publication: Sep. 16, 2004)

In the documents 1 and 2, a connection fitting fixed to one end of an electric wire is soldered to a terminal (electrode) of a cold cathode fluorescent tube. The other end of the electric wire is connected to an inverter circuit via a connector. Electrical power from the inverter circuit is supplied to the cold cathode fluorescent tube via the connector and the electric wire.

However, in the documents 1 and 2, there is a risk that conducting failure may occur between the terminal and the connection fitting due to defective soldering. In addition, the soldering is troublesome. In particular, the cold cathode fluorescent tube has a thin shape with a diameter of several millimeters, and the terminal is even thinner than this, so that handling of the cold cathode fluorescent tube requires great care. Therefore, great labor is required for soldering.

Not only the case of the cold cathode fluorescent tube, but also cases using other fluorescent tubes such as an external electrode fluorescent tube have a similar problem.

An object of the invention is to provide a fluorescent tube attaching structure which realizes easy and reliable electrical connection with a fluorescent tube.

SUMMARY OF THE INVENTION

A preferred mode of the present invention provides a fluorescent tube attaching structure for attaching a fluorescent tube extending in a longitudinal direction and having a pair of end portions with respect to the longitudinal direction and an intermediate portion between the pair of end portions, where a terminal is provided on the respective end portions. The attaching structure includes a base, a holder which is supported by the base and holds the intermediate portion of the fluorescent tube while restraining radial movements of the fluorescent tube, and a pair of contacts which is supported by the base and to which the terminals of the pair of end portions of the fluorescent tube can be attached in an attaching direction corresponding to a radial direction of the fluorescent tube. Each of the pair of contacts includes a main body and a pair of elastic pieces extending from the main body and facing each other. The pair of elastic pieces have a pair of straight portions extending substantially straight in the attaching direction and facing each other, respectively. On the pair of straight portions, a pair of contact portions for clamping the corresponding terminal of the fluorescent tube therebetween are formed.

According to this mode, between the contact portions of the straight portions of the pair of elastic pieces, the terminal of the fluorescent tube is elastically clamped. As a result, the contact portions come into contact with the terminal with a predetermined contact pressure, so that the contact and the terminal can be reliably electrically connected to each other.

In addition, by a simple operation of inserting the terminal of the fluorescent tube between the pair of straight portions extending along the fluorescent tube attaching direction, the contact and the terminal can be readily electrically connected to each other.

Furthermore, the intermediate portion of the fluorescent tube in the longitudinal direction is supported by the holder, so that the load applied to the terminal of the end portion of the fluorescent tube can be reduced in comparison with the case of supporting only both ends of the fluorescent tube. In addition, the span for supporting the fluorescent tube can be stably reduced, and as a result, the fluorescent tube can be supported steadly. Therefore, the fluorescent tube does not vibrate.

In addition, the pair of straight portions extend along the fluorescent tube attaching direction, and this provides the following advantage. That is, even if the holder and the fluorescent tube have variations in dimensional errors, the position of the terminal of the fluorescent tube in the attaching direction can be adjusted without applying an excessive force to the terminal of the fluorescent tube, by shifting the position of the terminal of the florescent tube along the straight: portions. Thereby, the variations in dimensional errors are absorbed. The positional deviation between the fluorescent tube and the holder can be prevented as much as possible, and the fluorescent tube can be reliably held by the holder.

DETAILED DESCRIPTION OF THE PREFERRED EMBODIMENTS

A preferred embodiment of the present invention will be described with reference to the accompanying drawings.

Figure 1:
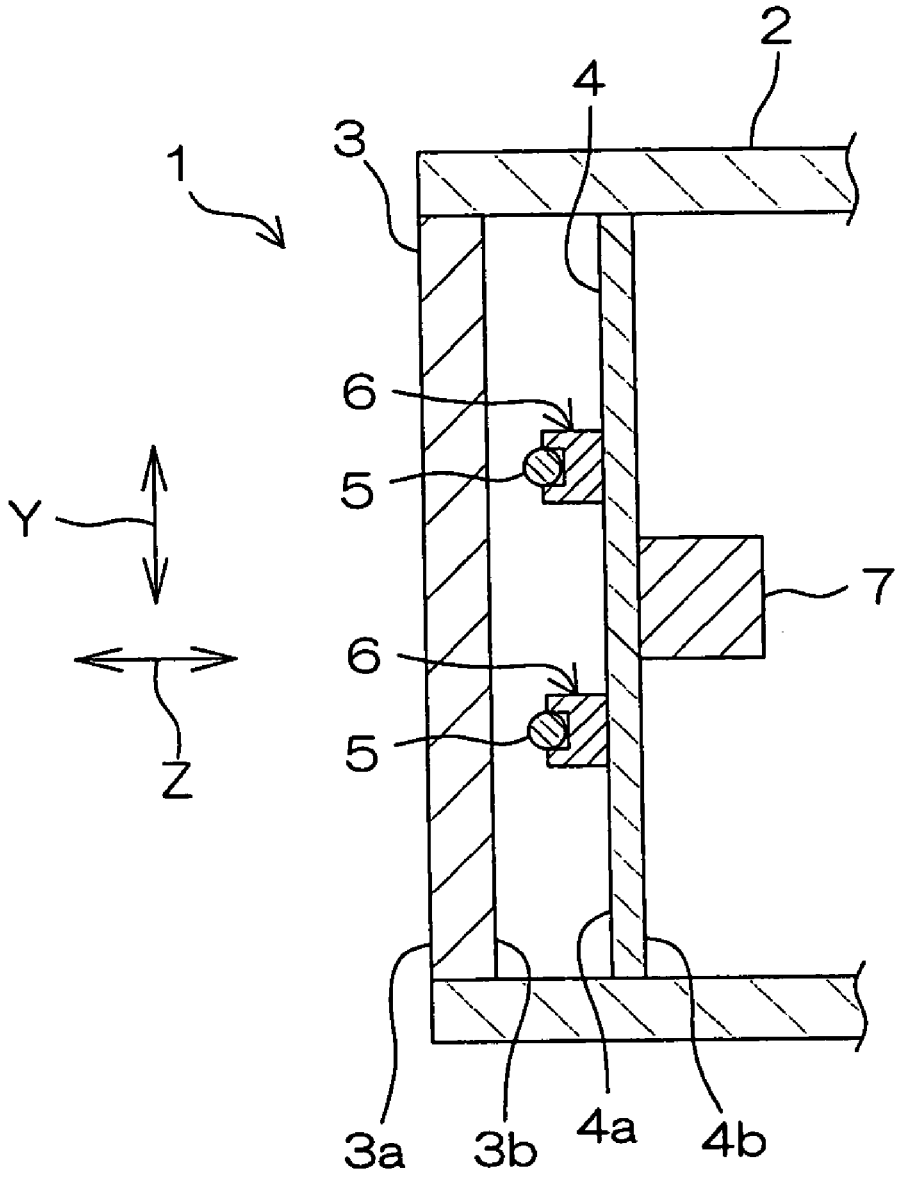
FIG. 1 is a schematic sectional view showing a general construction of a liquid crystal display device to which a fluorescent tube attaching structure according to an embodiment of the present invention is applied.

FIG. 1 is a schematic sectional view showing a general construction of a liquid crystal display device having a fluorescent tube attaching structure according to an embodiment of the present invention. Referring to FIG. 1, the liquid crystal display device 1 is used as, for example, a monitor of a television or a personal computer.

The liquid crystal display device 1 includes a casing 2, a liquid crystal panel 3, a circuit board 4 disposed in the rear of the liquid crystal panel 3, a plurality of cold cathode fluorescent tubes 5 as fluorescent tubes, electrical connectors 6 (hereinafter, also referred to as connectors, simply), and an inverter circuit 7.

The liquid crystal panel 3 is a non light-emitting display panel, and is attached to an opening on the front of the casing 2. A front face 3*a* of the liquid crystal panel 3 faces forward from the casing 2, and a back face 3*b* there of faces rearward from the casing 2.

The circuit board 4 is a plate-shaped member disposed substantially parallel to the liquid crystal panel 3 and fixed to the casing 2, and includes a first surface 4*a* facing the back face 3*b* of the liquid crystal panel 3 and a second surface 4*b* on the opposite side of the first surface 4*a*.

The cold cathode fluorescent tubes 5 serve as a backlight of the liquid crystal panel 3, and are disposed between the back face 3*b* of the liquid crystal panel 3 and the first surface 4*a* of the circuit board 4. The number of the cold cathode fluorescent tubes 5 is, for example, 2 per 1 inch of the liquid crystal panel 3.

Figure 2:
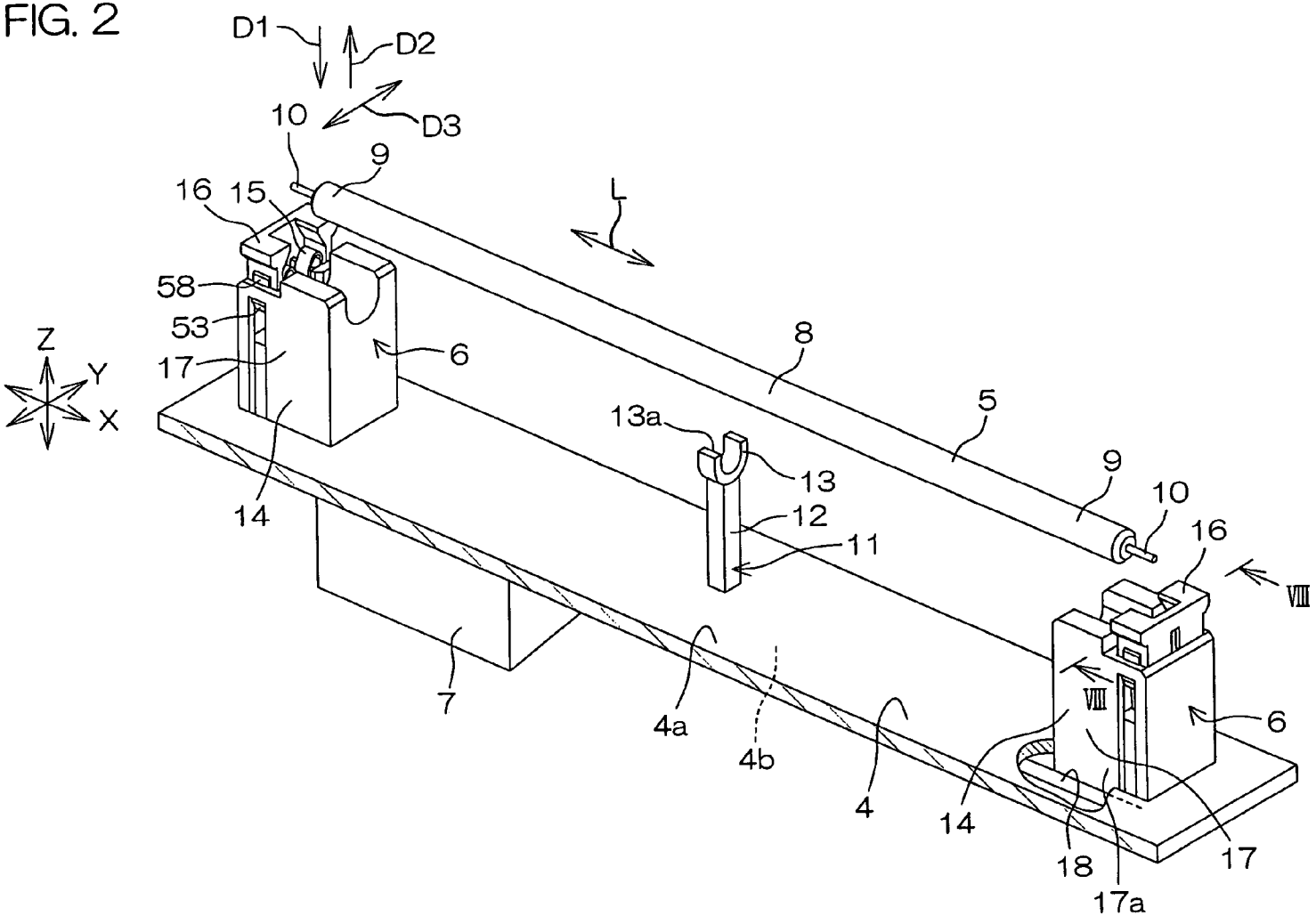
FIG. 2 is an exploded perspective view of the fluorescent tube attaching structure.

As shown in FIG. 2, a longitudinal direction L of the cold cathode fluorescent tubes 5 is in an direction X (corresponding to the left and right direction of the casing 2: direction perpendicular to the sheet surface in FIG. 1). Referring to FIG. 1, the respective cold cathode fluorescent tubes 5 are spaced at a predetermined distance along a direction Y (corresponding to the up and down direction of the casing 2). The cold cathode fluorescent tubes 5 are parallel to the back face 3*b* of the liquid crystal panel 3. The respective cold cathode fluorescent tubes 5 and the liquid crystal panel 3 are spaced at a predetermined distance from each other in a direction Z (corresponding to the front and rear direction of the casing 2). The respective cold cathode fluorescent tubes 5 irradiate the liquid crystal panel 3 with light from the rear side.

The electrical connector 6 is for realizing electrical connection between the cold cathode fluorescent tube 5 and the circuit board 4 (and the inverter circuit 7). This connector 6 is attached to each of a pair of end portions of each cold cathode fluorescent tube 5 between the back face 3*b* of the liquid crystal panel 3 and the first surface 4*a* of the circuit board 4. The respective connectors 6 are attached to the circuit board 4.

The inverter circuit 7 performs a function to supply driving power to the cold cathode fluorescent tubes 5, and is attached to the second surface 4*b* of the circuit board 4. The inverter circuit 7 and the respective cold cathode fluorescent tubes 5 are electrically connected to each other via the circuit board 4 and the corresponding connectors 6.

Figure 3:
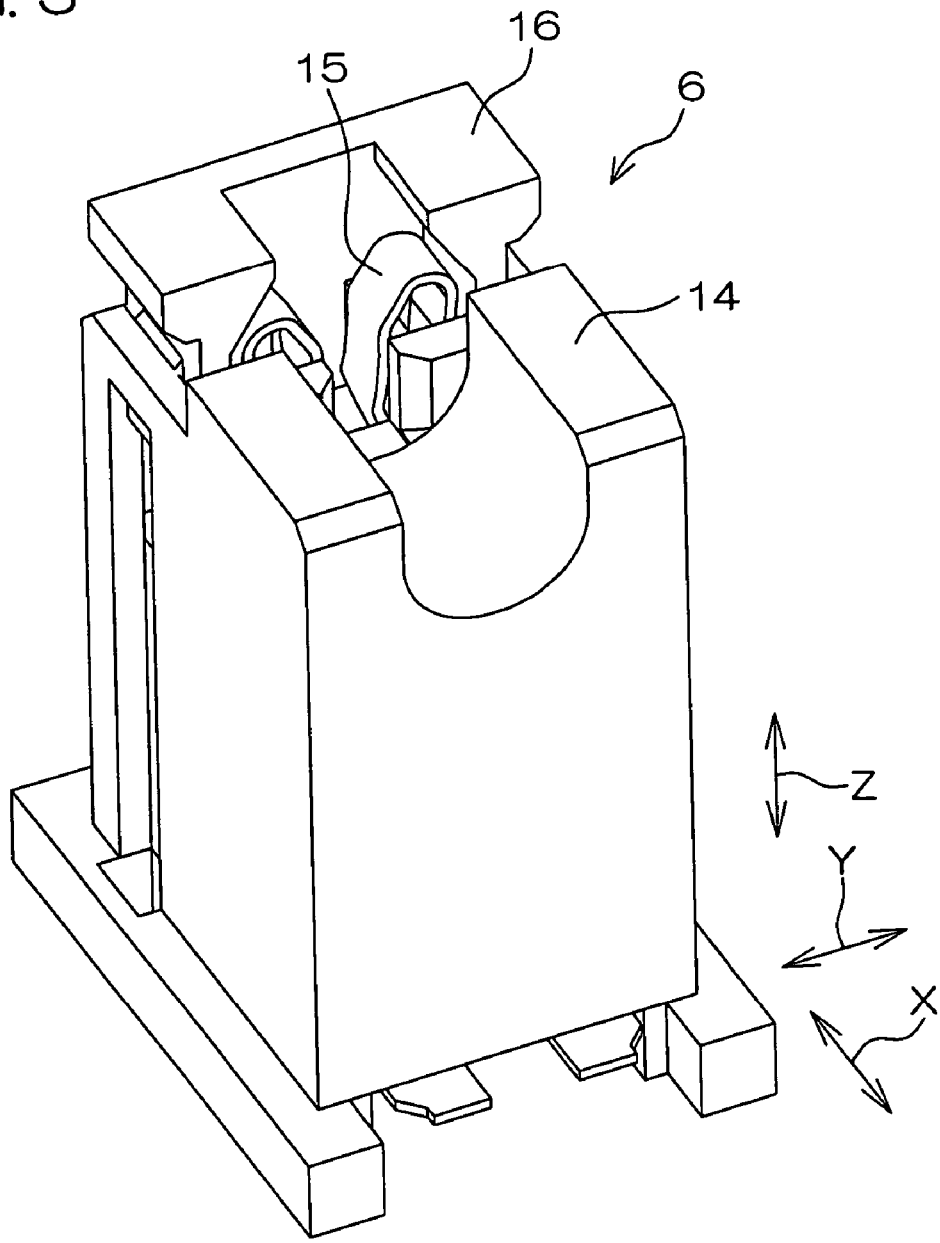
FIG. 3 is a perspective view of an electrical connector.

FIG. 2 is an exploded perspective view of a main part of FIG. 2. FIG. 3 is a perspective view of the connector 6.

The attaching-structures for the respective cold cathode fluorescent tubes 5 are the same, so the attaching structure of one of the cold cathode fluorescent tubes 5 will be mainly described below.

Referring to FIG. 2, the cold cathode fluorescent tube 5 includes a cylindrical main body 8 extending straight along the Direction X, and an outer leads 10 and 10 (electrodes) as a pair of terminals provided on a pair of terminal portions 9 and 9 of the main body 8, respectively. The outer lead 10 as a terminals projects along the longitudinal direction L from the corresponding end portions 9 of the main body 8.

The main body 8 is made of, for example, a glass member with a diameter of several millimeters to ten and several millimeters. The pair of outer leads 10 and 10 are metal shaft-like conductive members made of soft iron, etc., and are exposed in the direction X from the corresponding end portions 9. The outer leads 10 have a diameter of, for example, approximately 1 millimeter and a length of several millimeters.

A clamping member 11 is provided for holding the cold cathode fluorescent tube 5 and supporting the weight of the cold cathode fluorescent tube 5. One or more of the clamping member 11 (in this embodiment, one) is provided for each cold cathode fluorescent tube 5. The number of clamping members 11 is properly determined according to the length of the cold cathode fluorescent tube 5. The clamping member 11 is disposed at a middle portion of the main body 8 of the cold cathode fluorescent tube 5 with respect to the Direction X.

This clamping member 11 is, for example, a synthetic resin molding, and includes a support column 12 and an arced holder 13. The support column 12 is fixed to the first surface 4*a* of the circuit board 4 and extends in the Direction Z. The holder 13 holds the intermediate portion of the main body 8 of the cold cathode fluorescent tube 5 while restraining radial movements (Direction Y and Direction Z in FIG. 2) of the cold cathode fluorescent tube 5.

This holder 13 is in an arced shape that can surround a portion slightly longer than the peripheral half of the main body 8 of the cold cathode fluorescent tube 5. At a part of the holder 13 in the peripheral direction, an opening 13*a* into which the main body 8 of the cold cathode fluorescent tube 5 is inserted is formed.

Into the opening 13*a*, the intermediate portion of the main body 8 of the cold cathode fluorescent tube 5 in the longitudinal direction L is inserted and held along a first direction D1 as an attaching direction of the cold cathode fluorescent tube 5 to the connectors 6. The opening 13*a* is open to a second direction D2 (corresponding to a removing direction of the cold cathode fluorescent tube 5 from the connectors 6) opposite the first direction D1.

As described above, the connector 6 is provided on each of the pair of end portions 9 and 9 of the main body 8 of the cold cathode fluorescent tube 5. The constructions of the connectors 6 are the same, so that one of the connectors 6 will be mainly described below.

Referring to FIG. 3, the connector 6 has lengths of 10 to 15 millimeters in the X, Y, and Direction Zs, respectively, and includes a housing 14, a contact 15 held by this housing 14, and an operating member 16 for operating the contact 15.

Figure 4:
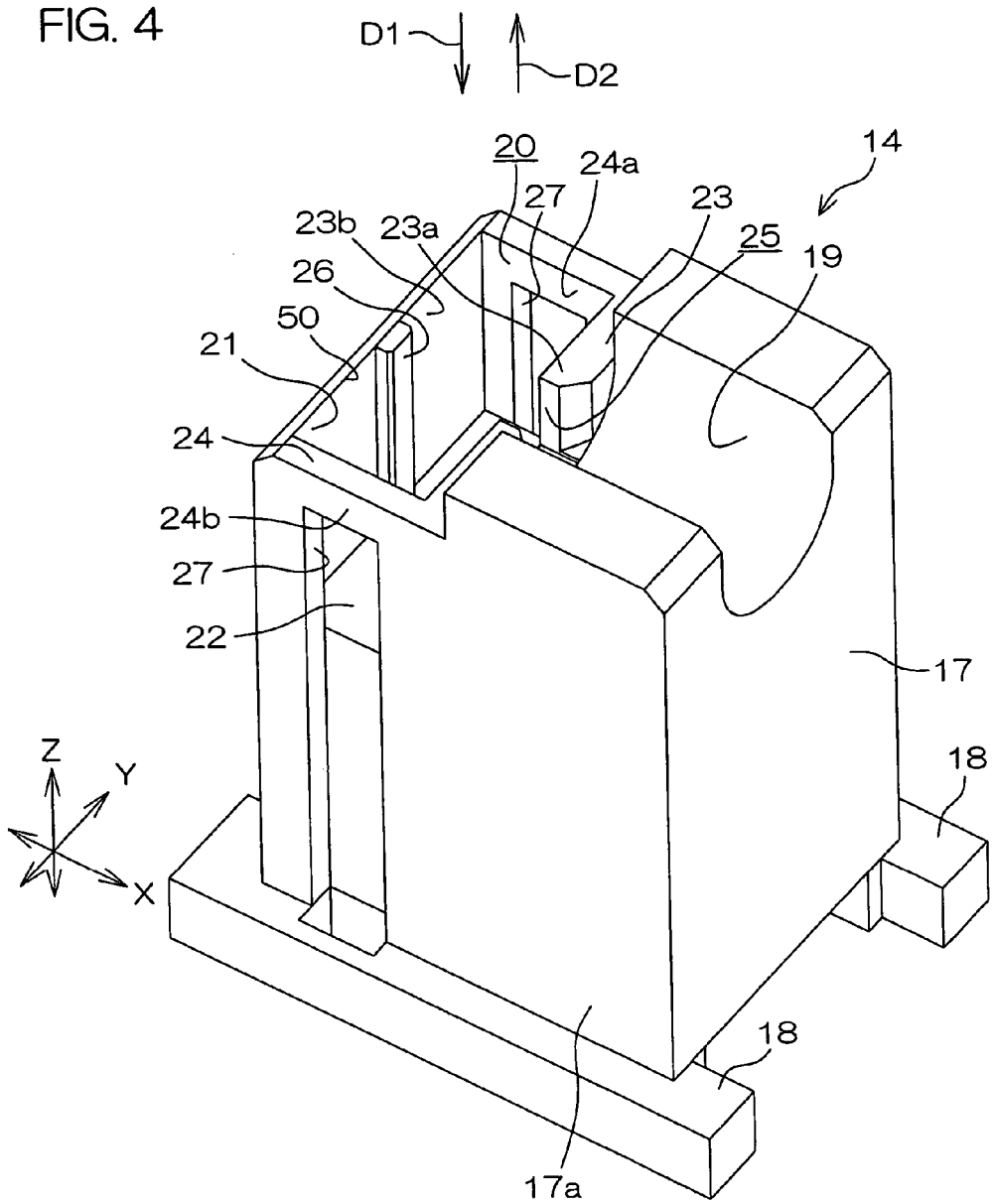
FIG. 4 is a perspective view of a housing of the electrical connector.

FIG. 4 is a perspective view of the housing 14. Referring to FIG. 2 and FIG. 4, the housing 14 is an integrally molding made of a synthetic resin, and has a main body 17 and seating portions 18 extending from the main body 17.

The main body 17 is generally shaped into a box. In the circuit board 4, a through hole is formed at a place where the connector 6 is disposed, and through this through hole, the main body 17 projects from the first surface 4*a* to the back face 3*b* (see FIG. 1) of the liquid crystal panel 3.

Referring to FIG. 2 and FIG. 4 again, at an end portion of the main body 17 with respect to the second direction D2, an introducing groove 19 having a U shape or a groove shape is formed. Into the introducing groove 19, a corresponding end portion 9 of the cold cathode fluorescent tube 5 is introduced. The end portion 9 of the cold cathode fluorescent tube 5 introduced into the introducing groove 19 is protected in a state of being surrounded by the inner surface of the introducing groove 19.

At an end portion of the main body 17 with respect to the second direction D2, an insertion recess 20 is provided. In the insertion recess 20, the outer lead 10 as the terminal of the cold cathode fluorescent tube 5 is inserted along the first direction D1 as the attaching direction.

The insertion recess 20 is defined by a peripheral wall 21 and a bottom wall 22 and has a rectangular cross-section, and functions as a receiving cavity for receiving the outer lead 10. The peripheral wall 21 includes a pair of first side portions 23*a* and 23*b* facing each other in the Direction X and a pair of second side portions 24*a* and 24*b* facing each other in the Direction Y.

The one first side portion 23*a* is adjacent to the introducing groove 19, and divides the introducing groove 19 and the insertion recess 20. The one first side portion 23*a* has a notched groove 25 formed at a central portion in the Direction Y. Through the notched groove 25, the corresponding outer lead 10 can be inserted.

The bottom of the notched groove 25 functions as a stopper to prevent the outer lead 10 from being shifted although this is not shown. Namely, when the outer lead 10 tilts at a predetermined angle with respect to the housing 14, the outer lead 10 is received by the bottom of the notched groove 25, and as a result, the outer lead 10 is prevented from tilting more.

The phrase "the outer lead 10 tilts with respect to the housing 14" means at least one-of a state that the entirety (the main body 8 and the outer lead 10) of the cold cathode fluorescent tube 5 tilts with respect to the housing 14 (circuit board 4) and a state that the main body 8 of the cold cathode fluorescent tube 5 does not tilt with respect to the housing 14 (parallel to the circuit board 4) and the outer lead 10 tilts with respect to the main body 8.

The other first side portion 23*b* is provided with a guide portion 26 for guiding the operating member 16 along the first and second directions D1 and D2 (Direction Z). This guide portion 26 is of a convex shape disposed on the inner side surface of the other first side portion 23*b*, and extends in the Direction Z.

In the pair of second side portions 24*a* and 24*b*, through holes 27 are respectively formed. The respective through holes 27 extend along the Direction Z. Into the through holes 27, first and second convex portions 53 and 58 described later of the operating member 16 are inserted.

The seating portions 18 are a pair of flange portions provided on the end portions 17*a* of the main body 17 with respect to the first direction D1. The seating portions 18 are respectively disposed on the pair of end portions of the main portion 17 with respect to the direction Y and longitudinally extend in the Direction X. The respective seating portions 18 are in abutment with and received by the second surface 4*b* of the circuit board 4. Thereby, the position of the housing 14 with respect to the direction Z regarding the circuit board 14 is determined.

Figure 5:
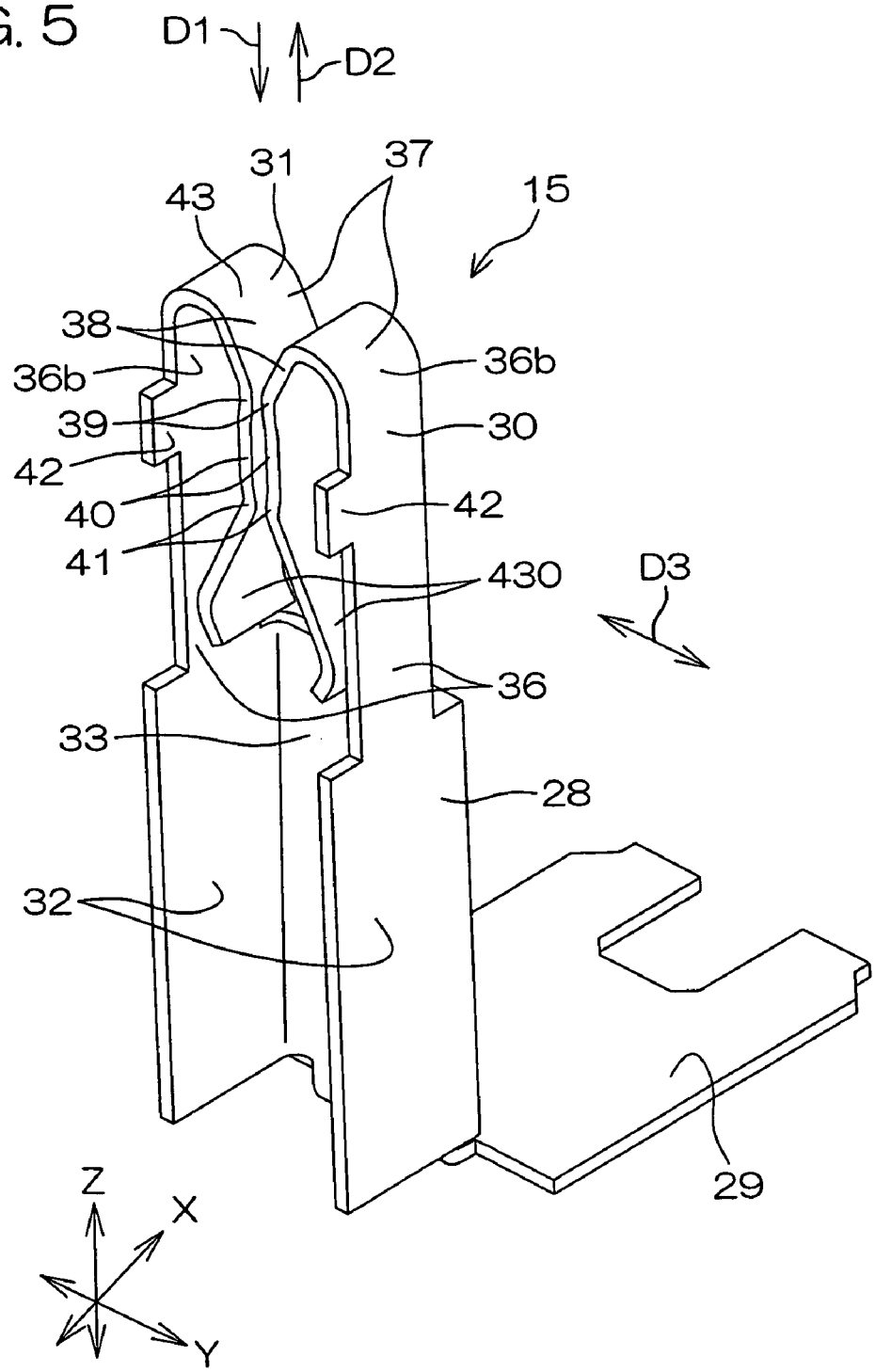
FIG. 5 is a perspective view of a contact.
Figure 6:
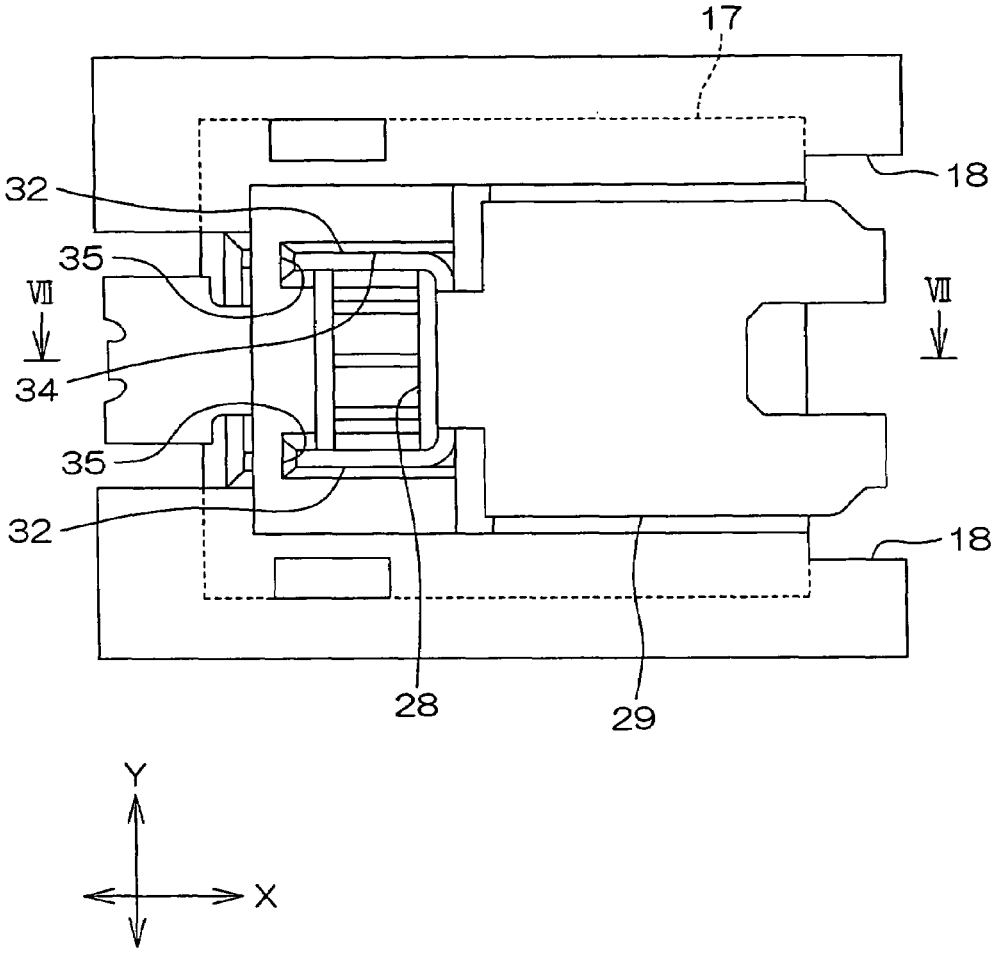
FIG. 6 is a plan view of the electrical connector observed along a second direction.
Figure 7:
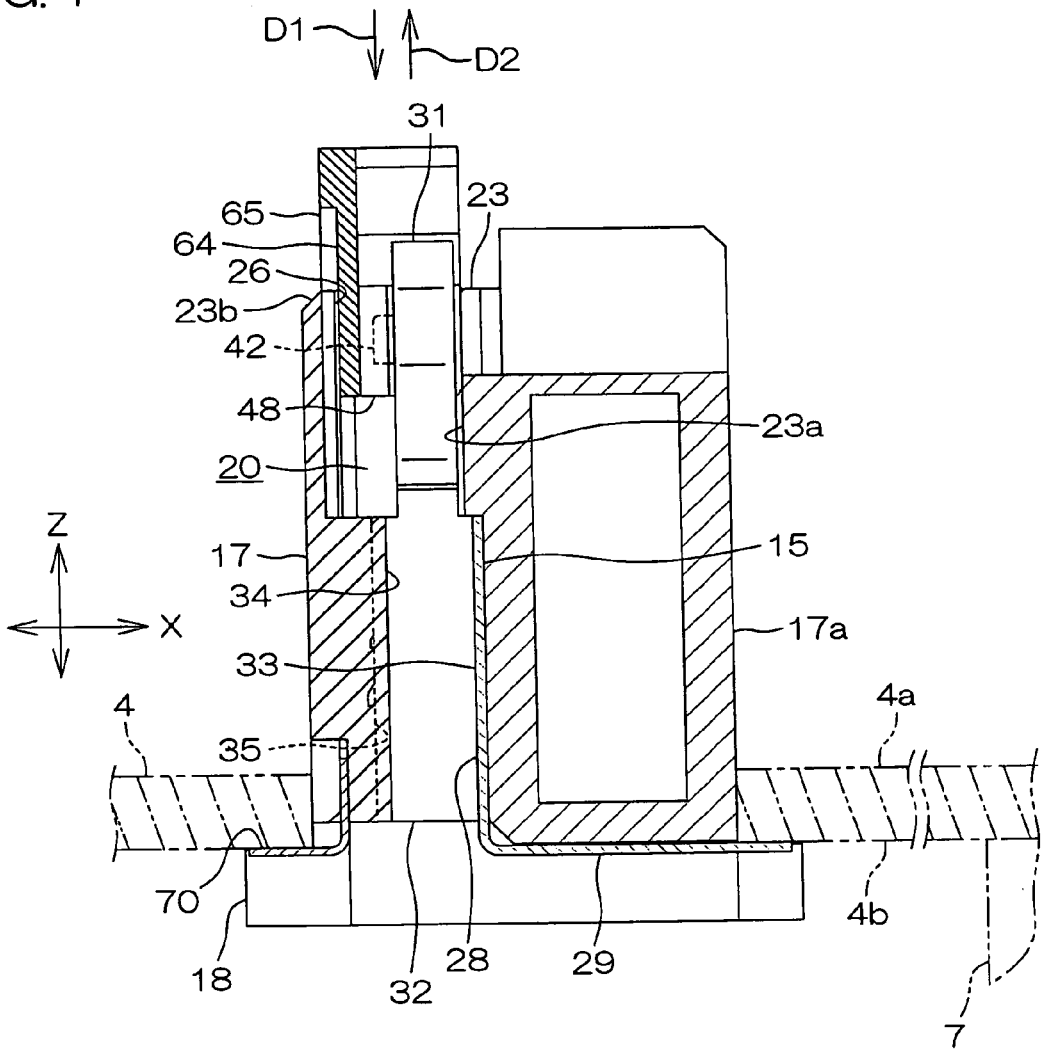
FIG. 7 is a sectional view along the VII-VII line of FIG. 6.
Figure 8:
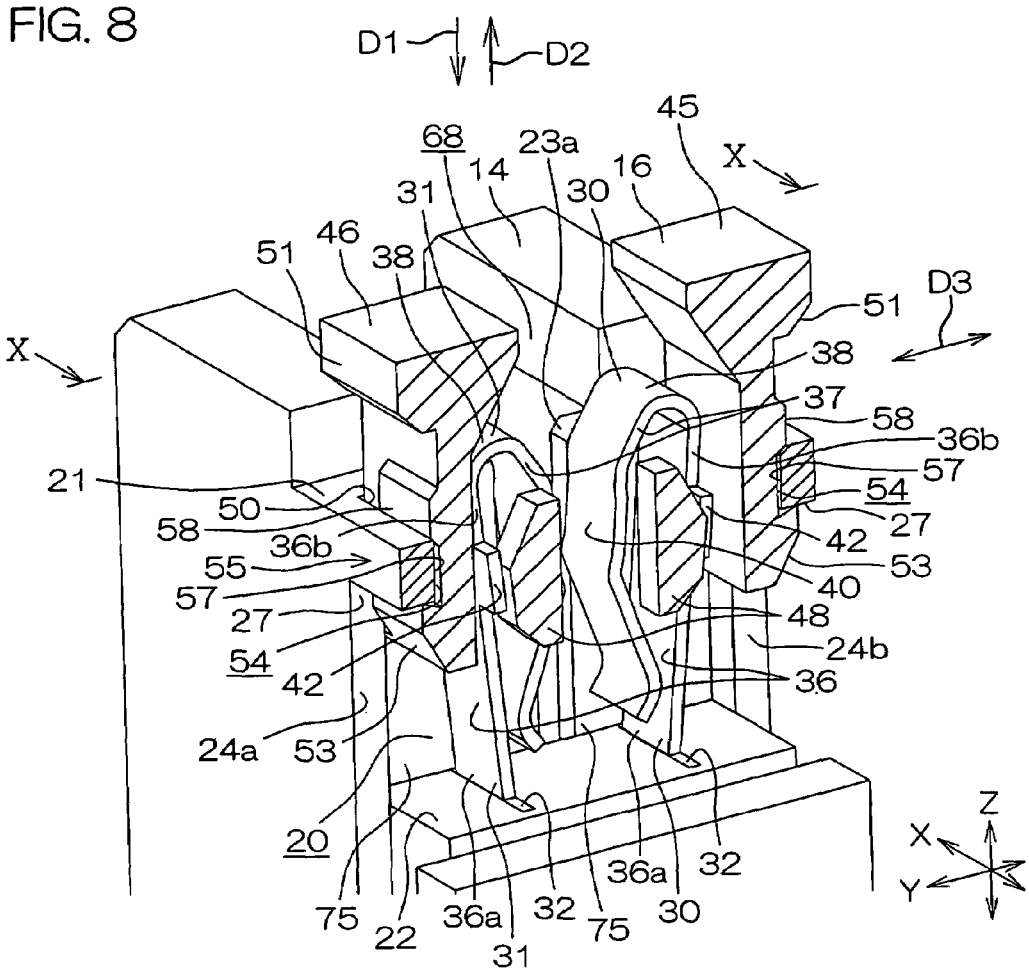
FIG. 8 is a partially broken perspective view including a cross-section along the VIII-VIII line of FIG. 2, showing a state where the contact is widened.
Figure 9:
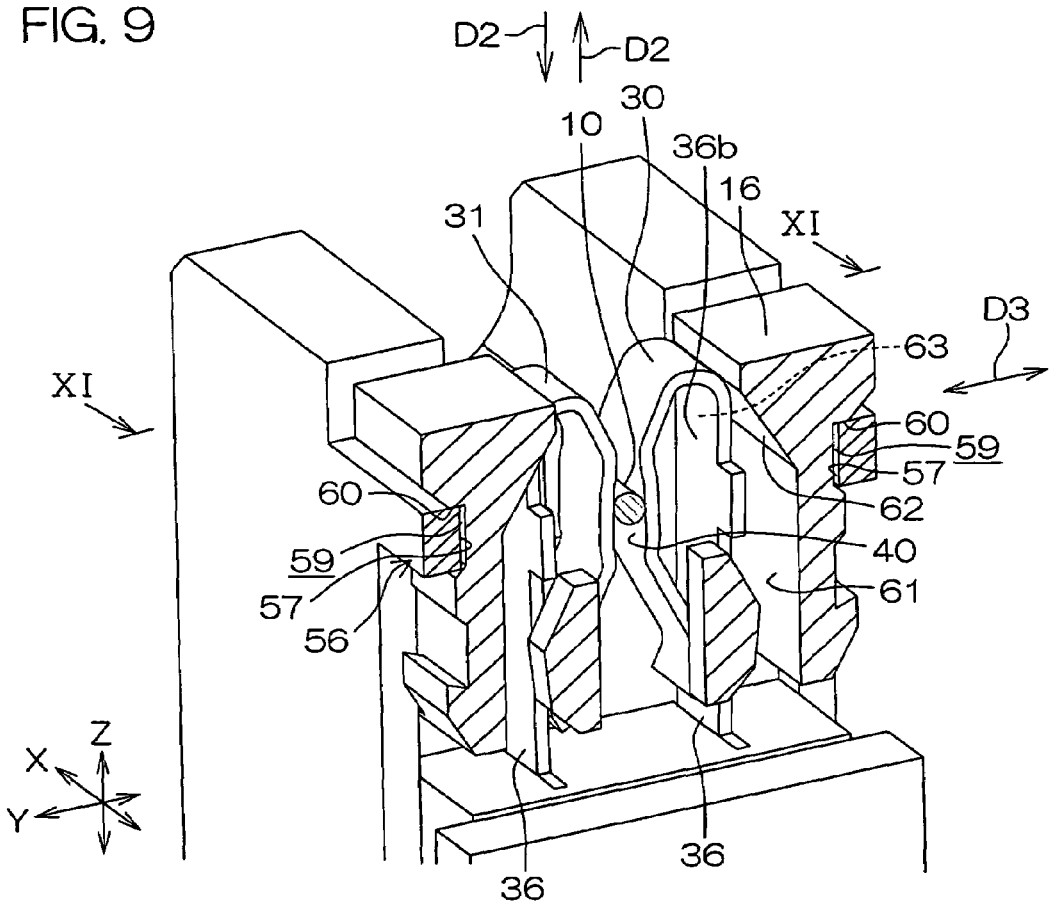
FIG. 9 is a partially broken perspective view including the cross-section along the VIII-VIII line of FIG. 2, showing a state where the widening of the contact is released.
Figure 10:
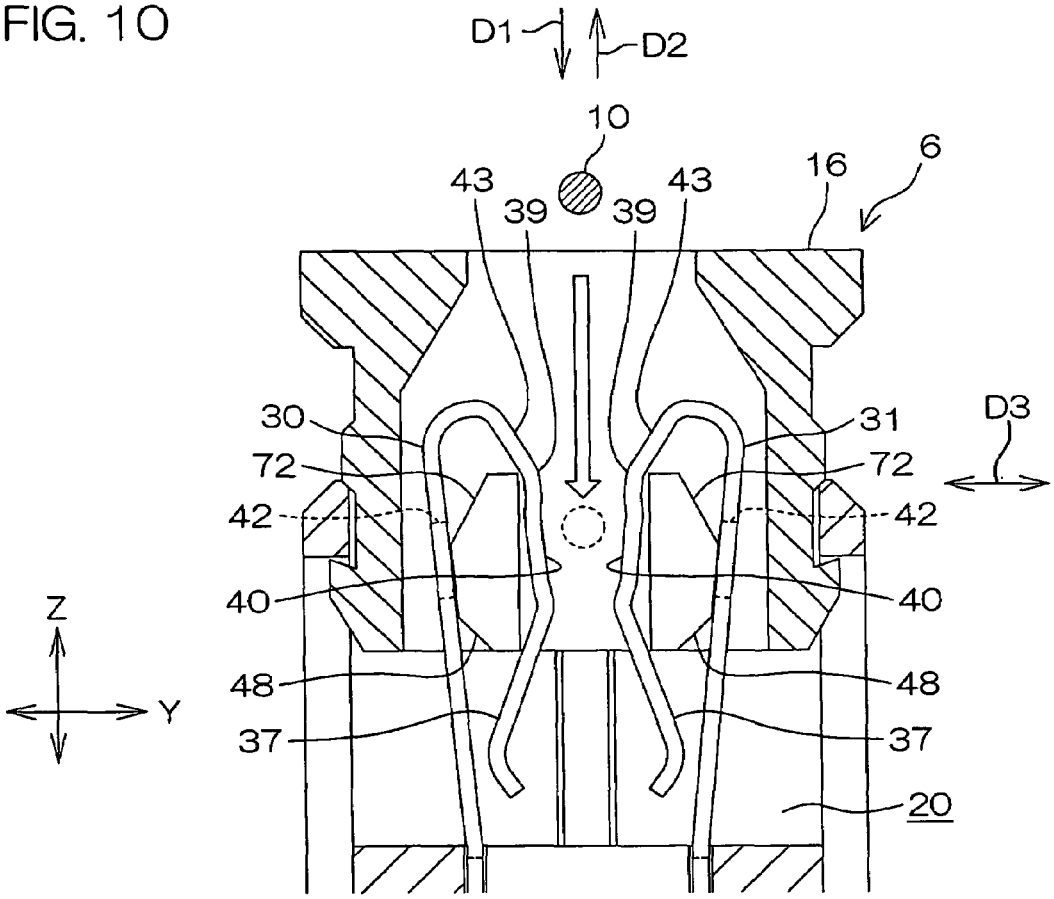
FIG. 10 is a sectional view along the X-X line of FIG. 8.
Figure 11:
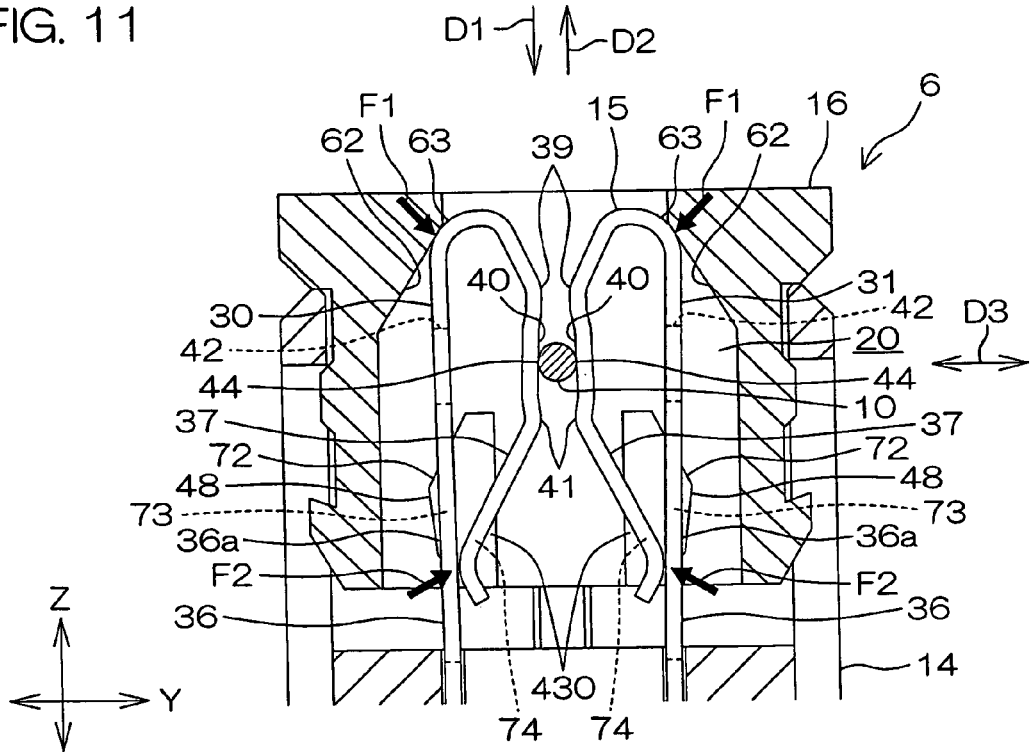
FIG. 11 is a sectional view along the XI-XI line of FIG. 9.

FIG. 5 is a perspective view of the contact 15. FIG. 6 is a plan view of the connector 6 observed along the second direction D2. FIG. 7 is a sectional view along the VII-VII line of FIG. 6. FIG. 8 is a sectional view of a main part along the VIII-VIII line of FIG. 2, showing a state that the contact 15 is widened. FIG. 9 is a sectional view of the main part along the VIII-VIII line of FIG. 2, showing a state that the widening of the contact 15 is released. FIG. 10 is a sectional view along the X-X line of FIG. 8. FIG. 11 is a sectional view along the XI-XI line of FIG. 9.

Referring to FIG. 2 and FIG. 5, the contact 15 is a conductive member made of a metal, etc. In particular, the contact 15 is a sheet metal member. The contact 15 makes electrical connection to the outer lead 10 of the cold cathode fluorescent tube 5. By the contact 15, electrical connection between the outer lead 10 and the circuit board 4 is realized.

The contact 15 is symmetrical to the Direction Y, and has a main body 28, a lead 29, and a pair of elastic pieces 30 and 31 facing each other.

The main body 28 longitudinally extends in the Direction Z, and has a U-shaped cross-section orthogonal to the Direction Z. The U-shaped paired portions facing each other are formed into flange portions 32. In the main body 28, the section sandwiched by the flange portions 32 is defined as an intermediate portion 33.

Referring to FIG. 6 and FIG. 7, the main body 28 is press-fitted in and fixed to an insertion hole 34 formed in the main body 17 of the housing 14. The insertion hole 34 extends in the Direction Z to the insertion recess 20 from the end portion 17*a* in the second direction D2 of the main body 17 of the housing 14. The peripheral surface of the insertion hole 34 surrounds the main body 28 of the contact 15.

On the peripheral surface of the insertion hole 34, a pair of engaging grooves 35 and 35 that engage respectively with the pair of flange portions 32 are formed. The engaging grooves 35 extend in the Direction Z, and along the engaging grooves 35, the main body 28 of the contact 15 can be inserted.

The main body 28 of the contact 15 is received by one end portion of the one first side portion 23*a* of the peripheral wall 21, and is positioned in the Direction Z with respect to the housing 14. It is allowed that the main body 28 of the contact 15 is not received by the one first side portion 23*a* of the peripheral wall 21 of the housing 14. In this case, according to the amount of insertion of the main body 28 into the insertion hole 34, the position of the contact 15 in the Direction Z is determined.

Referring to FIG. 5 and FIG. 7, the lead 29 comes into contact with the second surface 4*b* of the circuit board 4 and realizes electrical connection between the circuit board 4 and the contact 15. This lead 29 is provided on one end portion of the main body 28 and extends to one side of the Direction X from the main body 28. The lead 29 and the second surface 4*b* of the circuit board 4 are parallel to each other, and are in contact with each other. The lead 29 is soldered to the circuit board 4 and connected to the inverter circuit 7 via the circuit board 4. A metal reinforcing member 70 provided on the end portion 17*a* in the second direction D2 of the main body 17 of the housing 14 is fixed to the second surface 4*b* of the circuit board 4.

Referring to FIG. 2 and FIG. 8, the pair of elastic pieces 30 and 31 are electrically connected to the corresponding outer lead 10, respectively. The pair of elastic pieces 30 and 31 face each other in the Direction Y. The pair of elastic pieces 30 and 31 are disposed on the second direction D2 side with respect to the corresponding flange portions 32 and project to the insertion recess 20, and are almost entirely exposed to the insertion recess 20. It is also possible that only a part of the pair of elastic pieces 30 and 31 is exposed to the insertion recess 20.

Each of the pair of elastic pieces 30 and 31 includes a first piece 36 extending along the second direction D2 and a second piece 37 that is folded back from a tip end portion 36*b* of the corresponding first piece 36 and extends along the first direction D1. A pair of the first pieces 36 are disposed relatively distant from each other in the Direction Y, and a pair of the second pieces 37 are disposed relatively close to each other.

Each first piece 36 extends along the second direction D2 from the tip end portion in the second direction D2 of the corresponding flange portion 32, and penetrates the bottom wall 22 of the insertion recess 20 of the housing 14. The pair of elastic pieces 30 and 31 can be elastically made close or separated to or from each other around fulcrums at base end portions 36*a* of the respective first pieces 36. In a free state (with no external force applied), the first pieces 36 are arranged parallel to each other. At a tip end portion 36*b* of each first piece 36, an engaging portion 42 to engage with a widening operating portion 48 described later is provided. Each engaging portion 42 is formed by a small piece projecting to one side of the Direction X from the tip end portion 36*b* of the corresponding first piece 36.

Referring to FIG. 2 and FIG. 5, each second piece 37 includes a folded back portion 38 continued to the tip end portion 36*b* of the corresponding first piece 36, a first narrowing portion 39, a straight portion 40 as a clamping portion for clamping the outer lead 10 in a predetermined direction (corresponding to a radial direction of the outer lead 10), a second narrowing portion 41, and a tip end portion 430. The straight portion 40 extends straight along the first direction D1.

On one-side surfaces (outer side surfaces) of a pair of the folded back portions 38, guide portions 43 for guiding the attaching of the outer lead 10 are respectively provided (only one guide portion 43 is shown in FIG. 5). The pair of guide portions 43 narrow their distance toward the first direction D1.

The pair of first narrowing portions 39 are for preventing the corresponding outer lead 10 from improperly coming off in the second direction D2 from the pair of straight portions 40. The pair of first narrowing portions 39 are provided on the tip ends in the first direction D1 of the pair of folded back portions 38. In other words, they are provided on the opposite side of the first direction D1 with respect to the pair of straight portions 40.

The distance between the pair of first narrowing portions 39 is made narrower than the distance between the pair of guide portions 43, and made narrower than the distance between the pair of straight portions 40. When the pair of elastic pieces 30 and 31 are made close to each other, the distance between the pair of first narrowing portions 39 becomes narrower than the diameter of the outer lead 10.

The pair of straight portions 40 are for allowing relative movements of the corresponding outer lead 10 in the first and second directions D1 and D2 (Direction Z) while realizing electrical connection between the corresponding outer lead 10 and the contact 15. The respective straight portions 40 are provided on the first direction D1 side with respect to the corresponding first narrowing portions 39. The respective straight portions 40 extend along the direction Z (first direction D1) in the free state, face each other and are parallel to each other.

Referring to FIG. 11, in each straight portion 40, a portion in contact with the outer lead 10 forms a contact portion 44 between the back face 3*b* of the liquid crystal panel 3 and the first surface 4*a* (see FIG. 1) of the circuit board 4. The pair of contact portions 44 face each other in the Direction Y, and elastically clip the outer lead 10 therebetween.

Referring to FIG. 2 and FIG. 5 again, the pair of second narrowing portions 41 are for preventing the corresponding outer lead 10 from improperly coming off from the pair of straight portions 40 toward the first direction D1. The pair of second narrowing portions 41 are provided on the first direction D1 side with respect to the pair of straight portions 40.

The distance between the pair of second narrowing portions 41 is set narrower than the distance between the pair of straight portions 40. When the pair of elastic pieces 30 and 31 come close to each other, the distance between the pair of second narrowing portions 41 becomes narrower than the diameter of the outer lead 10.

The respective tip end portions 430 are provided on the first direction D1 side with respect to the corresponding second narrowing portions 41. These tip end portions 430 are for narrowing the distance between the pair of straight portions 40 by being pressed by the first pieces 36. Thereby, the force for clamping the outer lead 10 by the pair of straight portions 40 can be increased. In addition, lowering in the clamping force due to settling of the pair of elastic pieces 30 and 31 can be prevented.

The pair of tip end portions 430 are in an inverted V shape when they are observed along the Direction X, and the distance therebetween expands toward the first direction D1. On the tip ends in the first direction D1 of the respective tip end portions 430, bent portions that are bent in directions of approaching each other are provided so as to smoothly engage with the corresponding first pieces 36.

Referring to FIG. 2 and FIG. 8, the operating member 16 is for performing operations of clamping the outer lead 10 and releasing this clamping by the pair of straight portions 40, and are relatively movably fitted in the insertion recess 20 of the housing 14 in the first and second directions D1 and D2. In FIG. 8, the operating member 16 at a widening position is illustrated, and in FIG. 9, the operating member 16 at a widening released position is illustrated.

Figure 12:
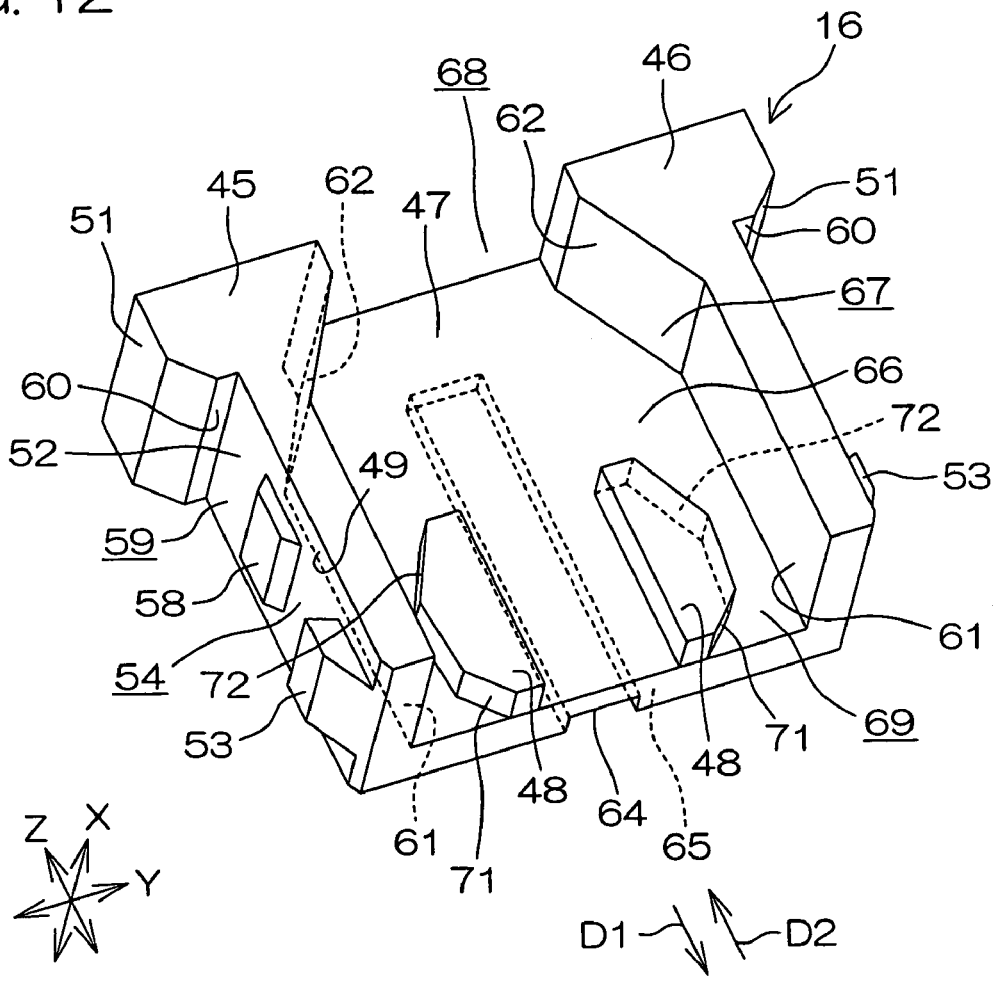
FIG. 12 is a perspective view of an operating member.

FIG. 12 is a perspective view of the operating member 16. Referring to FIG. 8 and FIG. 12, the operating member 16 is a resin molding formed symmetrically with respect to the Direction Y. A section orthogonal to the Direction Z of the operating member 16 is in a groove shape.

The operating member 16 has a pair of portions 45 and 46 facing each other at a distance in the Direction Y, a joint 47 that joins the pair of portions 45 and 46, and a pair of widening operating portions 48 provided on the joint 47.

The pair of portions 45 and 46 are disposed on both sides of the pair of elastic pieces 30 and 31 in the insertion recess 20. The one portion 45 is disposed between the one elastic piece 30 and the other second side portion 24*b* of the peripheral wall 21. The other portion 46 is disposed between the other elastic piece 31 and the one second side portion 24*a* of the peripheral wall 21. The pair of portions 45 and 46 respectively longitudinally extend in the Direction Z.

The tip ends on the second direction D2 side of outer side surfaces 49 of the pair of portions 45 and 46 (only one outer side surface 49 is shown in FIG. 8 and FIG. 12) project outward of the Direction Y with respect to a peripheral edge 50 of the opening of the insertion recess 20, and these projecting portions serve as knobs 51. An operator can operate the operating member 16 in the first and second directions D1 and D2 by pinching the knobs 51.

In the pair of outer side surfaces 49, portions where the knobs 51 are not provided are formed into straight portions 52 extending in the Direction Z. On the respective straight portions 52, first convex portions 53 are provided. A pair of the first convex portions 53 are for preventing the operating member 16 from improperly coming off from the insertion recess 20, and are disposed on tip ends in the first direction D1 of the respective straight portions 52.

The first convex portions 53 are fitted respectively in the corresponding through holes 27 of the peripheral wall 21, and they are received by the peripheral edges of the corresponding through holes 27 to prevent the operating member 16 from coming off from the insertion recess 20.

The tip end on the first direction D1 side of each first convex portion 53 is formed into inclined shapes. Thereby, when the operating member 16 is fitted in the insertion recess 20, these inclined portions allow insertion of the respective first convex portions 53 into the corresponding through holes 27 while smoothly engaging with the peripheral edge 50 of the opening of the peripheral wall 21.

Referring to FIG. 8 and FIG. 9, the connector 6 is provided with first and second holding mechanisms 55 and 56.

The first holding mechanism 55 holds the operating member 16 at the widening position shown in FIG. 8. Referring to FIG. 8 and FIG. 12, the first holding mechanism 55 includes first concave portions 54 provided on the respective straight portions 52 of the operating member 16, and engaging portions 57 that are respectively provided on the pair of second side portions 24 of the peripheral wall 21 and engage with corresponding first concave portions 54.

The first concave portion 54 is defined between the first convex portion 53 and second convex portion 58. The second convex portions 58 are provided on the respective straight portions 52 and arranged with the corresponding first convex portions 53 along the second direction D2. The engaging portions 57 include portions disposed on the second direction D2 side with respect to the through holes 27 on the pair of second side portions 24 of the peripheral wall 21, respectively, and are fitted in the first concave portions 54 when the operating member 16 is at the widening position shown in FIG. 8.

Referring to FIG. 9 and FIG. 12, the second holding mechanism 56 holds the operating member 16 at the widening released position shown in FIG. 9 and FIG. 11. The second holding mechanism 56 includes second concave portions 59 provided on the respective straight portions 52 of the operating member 16 and the engaging portions 57 that are provided on the pair of second side portions 24 of the peripheral wall 21, respectively, and engage with corresponding second concave portions 59. Namely, the engaging portions 57 form a part of the first holding mechanism 55 and a part of the second holding mechanism 56.

The second concave portions 59 are defined between the second convex portions 58 and stepped portions 60 of the respective knobs 51 facing the peripheral wall 21 side. The engaging portions 57 are fitted in the second concave portions 59 when the operating member 16 is at the widening released position shown in FIG. 9.

Inner side surfaces 61 of the pair of portions 45 and 46 face each other at a predetermined distance in the Direction Y and sandwich the pair of elastic pieces 30 and 31 of the contact 15. Tip ends in the second direction D2 of these inner side surfaces 61 of the pair of portions 45 and 46 are formed into inclined cam surfaces, and the distance therebetween narrows toward the second direction D2.

By the inclined cam surfaces, pressurizing portions 62 are formed. A pair of the pressurizing portions 62 can pressurize pressurized portions 63 provided on the tip end portions 36*b* of the corresponding first pieces 36 of the pair of elastic pieces 30 and 31. When the operating member 16 is at the widening released position shown in FIG. 9, the pair of pressurizing portions 62 come into contact with and pressurize the corresponding pressurized portions 63, thereby the distance between the pair of straight portions 40 is narrowed, and as a result, the force for clamping the outer lead 10 by these straight portions 40 can be increased. In addition, lowering in the clamping force due to settling of the pair of elastic pieces 30 and 31 can be prevented.

The pair of pressurizing portions 62 come into contact with and pressurize corresponding pressurized portions 63 when the operating member 16 shifts from the widening position shown in FIG. 8 to the widening released position shown in FIG. 9 along the first direction D1. Thereby, the forces for pressurizing the corresponding pressurized portions 63 in the first direction D1 are converted into forces in the Direction Y orthogonal to the first direction D1. Thereby, the pair of elastic pieces 30 and 31 come close to each other.

The joint 47 is formed into a plate shape, and joins one-side ends of the pair of portions 45 and 46 with respect to the direction X. On outer side surface 65 of the joint 47, a groove 64 extending in the Direction Z is formed, and is fitted in the guide portion 26 of the other first side portion 23*b* of the peripheral wall 21 as shown in FIG. 7.

Referring to FIG. 4 and FIG. 12, in the operating member 16, an external form of a cross-section of a portion where the knob 51 is not provided is cut along a direction orthogonal to the direction Z is generally identical with the shape of the peripheral edge 50 of the opening of the insertion recess 20 observed from the first direction D1. Thereby, the insertion recess 20 serves as a guide groove for guiding the operating member 16 to the widening position and the widening released position along the first and second directions D1 and D2.

Referring to FIG. 8 and FIG. 12, by an inner side surface 66 of the joint 47 and the inner side surfaces 61 of the pair of portions 45 and 46, a space 67 (space between the pair of portions 45 and 46) in which the pair of elastic pieces 30 and 31 can be accommodated is defined.

The tip end in the first direction D1 and the tip end in the second direction D2 of this space 67 are respectively open to the outside, and these open points are formed into a pair of open portions 68 and 69. Due to the open portion 68, the space 67 is open to the second direction D2, and this enables the space 67 to be observed from the outside. In addition, the corresponding outer lead 10 can be inserted into the space 67 through the open portion 68.

The pair of widening operating portions 48 are formed by small pieces provided on the inner side surface 66 of the joint 47. The pair of widening operating portions 48 perform the function to widen the distance between the straight portions 40 of the pair of second pieces 37 via the pair of first pieces 36 by engaging with the corresponding engaging portions 42 of the pair of elastic members 30 and 31. The pair of widening operating portions 48 are arranged parallel in the Direction X, and are sandwiched between the pair of engaging portions 42.

Each of the pair of widening operating portions 48 has a first inclined cam surface 71 provided on the tip end in the first direction D1 and a second inclined cam surface 72 provided on the tip end in the second direction D2.

A pair of the first inclined cam surfaces 71 perform a function to widen the distance between the pair of engaging portions 42 when the operating member 16 is fitted in the insertion recess 20 along the first direction D1. The distance between the pair of inclined cam surfaces 71 narrows toward the first direction D1.

The pair of first inclined cam surfaces 71 abut with the corresponding engaging portions 42 when the operating member 16 shifts toward the first direction D1. Thereby, the force of the operating member 16 to press the engaging portions 42 toward the first direction D1 is converted into forces in the Direction Y orthogonal to the first direction D1 (forces to widen the distance between the pair of engaging portions 42).

The pair of second inclined cam surfaces 72 abut with the corresponding engaging portions 42 when the operating member 16 moves along the second direction D2 and shifts from the widening released position to the widening position, thereby performing the function to widen the distance between the pair of engaging portions 42. The distance between the pair of inclined cam surfaces 72 narrows toward the second direction D2.

The pair of second inclined cam surfaces 72 abut with the corresponding engaging portions 42 when the operating member 16 shifts to the widening position. Thereby, the forces of the operating member 16 to press the engaging portions 42 toward the second direction D2 are converted into forces in the Direction Y orthogonal to the second direction D2 (forces to widen the distance between the pair of engaging portions 42).

Referring to FIG. 11, each widening operating portion 48 includes a first restraining portion 73. Each first restraining portion 73 is for restraining the first piece 36 of the corresponding elastic piece 30 or 31 from shifting in the Direction X (longitudinal direction L of the cold cathode fluorescent tube 5: direction along the axial direction of the outer lead 10) when the operating member 16 is at the widening released position.

When the operating member 16 is at the widening released position shown in FIG. 11, each first restraining portion 73 faces the base end portion 36*a* of the corresponding first piece 36 and restricts this corresponding first piece 36 from moving to one side (deep side of the sheet surface of FIG. 11) of the Direction X.

In addition, each widening operating portion 48 includes a second restraining portion 74. Each second restraining portion 74 is for restraining the second piece 37 of the corresponding elastic member 30 or 31 from shifting in the Direction X (direction along the axial direction of the outer lead 10) when the operating member 16 is at the widening released position.

When the operating member 16 is at the widening released position, each second restraining portion 74 faces the tip end portion 430 of the corresponding second piece 37, and restricts this corresponding second piece 37 from moving to one side (deep side of the sheet surface of FIG. 11) of the Direction X.

Referring to FIG. 8, the first side portion 23*a* of the peripheral wall 21 includes a third restraining portion 75. The third restraining portion 75 is for restraining the respective first pieces 36 of the pair of elastic pieces 30 and 31 from shifting in the Direction X (direction along the axial direction of the outer lead 10). The third restraining portion 75 faces the first pieces 36, and restricts these first pieces 36 from moving to the other side of the Direction X.

Referring to FIG. 10 and FIG. 11, the widening position of the operating member 16 is a position for widening the distance between the pair of straight portions 40 by the widening operating portions 48 so that the outer lead 10 can be inserted between the pair of straight portions 40 with no insertion force. The widening released position is a position for releasing this widening.

Referring to FIG. 10, in the liquid crystal display device having the above described general construction, the cold cathode fluorescent tube 5 (outer lead 10) is mounted as follows. Namely, first, the operating member 16 is held at the widening position shown in FIG. 10. The pair of widening operating portions 48 of the operating member 16 engage with the engaging portions 42 of the corresponding elastic members 30 and 31, and the distance between the pair of second pieces 37 is widened. At this time, the distance between the pair of straight portions 40 is made wider than the diameter of the outer lead 10, and the distance between the pair of first narrowing portions 39 is made wider than the diameter of the outer lead 10.

In this state, as shown in FIG. 2 and FIG. 10, the corresponding cold cathode fluorescent tube 5 is grasped by hand (not shown), etc., and the outer lead 10 of the cold cathode fluorescent tube 5 is made to face the operating member 16 in the Direction Z. Then, the cold cathode fluorescent tube 5 is moved toward the first direction D1 as the attaching direction and the middle portion of the cold cathode fluorescent tube 5 is fitted in the holder 13 of the clamping member 11. Thereby, the middle portion of the cold cathode fluorescent tube 5 is held by the clamping member 11, and the corresponding outer lead 10 of the cold cathode fluorescent tube 5 is moved into the insertion recess 20 as shown by the outline arrow and disposed between the pair of straight portions 40.

Next, the operating member 16 is moved toward the first direction D1 and shifted from the widening position shown in FIG. 10 to the widening released position shown in FIG. 11. Thereby, the engagement of the pair of engaging portions 42 by the pair of widening operating portions 48 is released, and as a result, by the elastic forces of the pair of elastic pieces 30 and 31, the pair of straight portions 40 clip the corresponding outer lead 10 by the contact portions 44. Thereby, electrical connection between the contact 15 and the corresponding outer lead 10 is realized. The distance between the pair of first and second narrowing portions 39 and 41 becomes narrower than the diameter of the corresponding outer lead 10.

In addition, by shifting the operating member 16 to the widening released position, the pair of pressurizing portions 62 pressurize the corresponding pressurized portions 63 as shown by the arrow F1. Thereby, these pressurized portions 63 are moved in the Direction Y so as to come close to each other. Thereby, the distance between the pair of first pieces 36 is narrowed, and as a result, pressurizing forces act on the pair of second pieces 37 so as to narrow the distance between the straight portions 40. Thereby, the force for clamping the corresponding outer lead 10 by the pair of straight portions 40 is increased.

Furthermore, when the operating member 16 shifts to the widening released position, the base end portions 36*a* of the pair of first pieces 36 press the tip end portions 430 of the corresponding second pieces 37 as shown by the arrow F2. Thereby, these tip ends 430 are moved in the Direction Y so as to come close to each other. Thereby, the distance between the pair of tip end portions 430 is narrowed, and as a result, pressurizing forces act to narrow the distance between the pair of straight portions 40. Thereby, the force for clamping the outer lead 10 by the pair of straight portions 40 is further increased.

On the other hand, in order to remove the outer lead 10 from the contact 15, the operating member 16 is first shifted from the widening released position to the widening position along the second direction D2 as shown in FIG. 10. When the operating member 16 is shifted to the widening position, the second inclined cam surfaces 72 of the pair of widening operating portions 48 engage with corresponding engaging portions 42 and widen the distance between the pair of engaging portions 42, and accordingly, the distance between the pair of straight portions 40 is widened. The electrical connection between the pair of straight portions 40 and the corresponding outer lead 10 is released.

Next, as shown in FIG. 2 and FIG. 10, the cold cathode fluorescent tube 5 is removed from the holder 13 of the clamping member 11 by grasping the cold cathode fluorescent tube 5 by hand, etc., and moved toward the second direction D2. Thereby, the corresponding outer lead 10 of the cold cathode fluorescent tube 5 passes between the pair of first narrowing portions 39 and between the pair of guide portions 43 from the pair of straight portions 40, and is then extracted from the insertion recess 20.

As described above, according to this embodiment, the straight portions 40 of the pair of elastic pieces 30 and 31 come into contact with the corresponding outer lead 10 of the cold cathode tube 5 with a predetermined contact pressure by elastically clamping the outer lead 10. Thereby, electrical connection between the contact 15 and the outer lead 10 can be reliably performed. In addition, the contact 15 and the corresponding outer lead 10 can be easily connected by a simple operation of moving the cold cathode fluorescent tube 5 toward the first direction D1 and inserting the outer lead 10 between the pair of straight portions 40.

Furthermore, by extending the pair of straight portions 40 along the first direction D1 (Direction Z), for example, even if the holder 13 of the clamping member 11 and the cold cathode fluorescent tube 5 have variations in dimensional errors and the like, the position of the cold cathode fluorescent tube 5 can be adjusted and the variations in dimensional errors and the like can be absorbed by moving the outer lead 10 of the cold cathode fluorescent tube 5 clipped between the pair of straight portions 40 along the first direction D1.

Therefore, positional deviation between the cold cathode fluorescent tube 5 and the holder 13 can be prevented, and the cold cathode fluorescent tube 5 can be reliably received and held by the holder 13. An excessive force can be prevented from acting on the pair of end portions 9 of the cold cathode fluorescent tube 5 because the cold cathode fluorescent tube 5 is prevented from being supported only by the end portions 9 of the cold cathode fluorescent tube 5. In addition, the supporting span of the cold cathode fluorescent tube 5 can be reliably shortened, so that the cold cathode fluorescent tube 5 can be prevented from vibrating.

Furthermore, by folding-back the second pieces 37 of the pair of elastic pieces 30 and 31 from the tip end portions 36*b* of the corresponding first pieces 36 and extending the second pieces 37 along the first direction D1, the flexibility of the second pieces 37 can be increased, and when the outer lead 10 is inserted between the straight portions 40, an excessive reactive force can be prevented from acting on the outer lead 10.

Furthermore, by providing the first narrowing portion 39 on the pair of elastic pieces 30 and 31, respectively, when the outer lead 10 clipped between the pair of straight portions 40 moves toward the second direction D2, for example, the pair of first narrowing portions 39 can receive the outer lead 10. Thereby, the outer lead 10 can be prevented from improperly coming off from the pair of straight portions 40 toward the second direction D2.

In addition, by providing the second narrowing portion 41 on the pair of elastic pieces 30 and 31, respectively, when the outer lead 10 clipped between the pair of straight portions 40 moves toward the first direction D1, for example, this outer lead 10 can be received by the pair of second narrowing portions 41. Thereby, the outer lead 10 can be prevented from coming off from the pair of straight portions 40 toward the first direction D1.

Furthermore, the guide portions 43 provided on each of the pair of elastic pieces 30 and 31 are formed so as to narrow the distance therebetween toward the first direction D1. Thereby, when the outer lead 10 is inserted between the pair of straight portions 40, the insertion of the outer lead 10 can be guided by the pair of guide portions 43. Therefore, the outer lead 10 can be more readily attached to the straight portions 40.

In addition, by arranging the opening direction of the opening 13*a* of the holder 13 of the clamping member 11 along the second direction D2, the attaching direction of the cold cathode fluorescent tube 5 to the contact 15 and the attaching direction of the cold cathode fluorescent tube 5 to the holder 13 can be matched with each other. As a result, the cold cathode fluorescent tube 5 can be more readily attached.

The present invention is not limited to the contents described in the embodiment given above.

Figure 13:
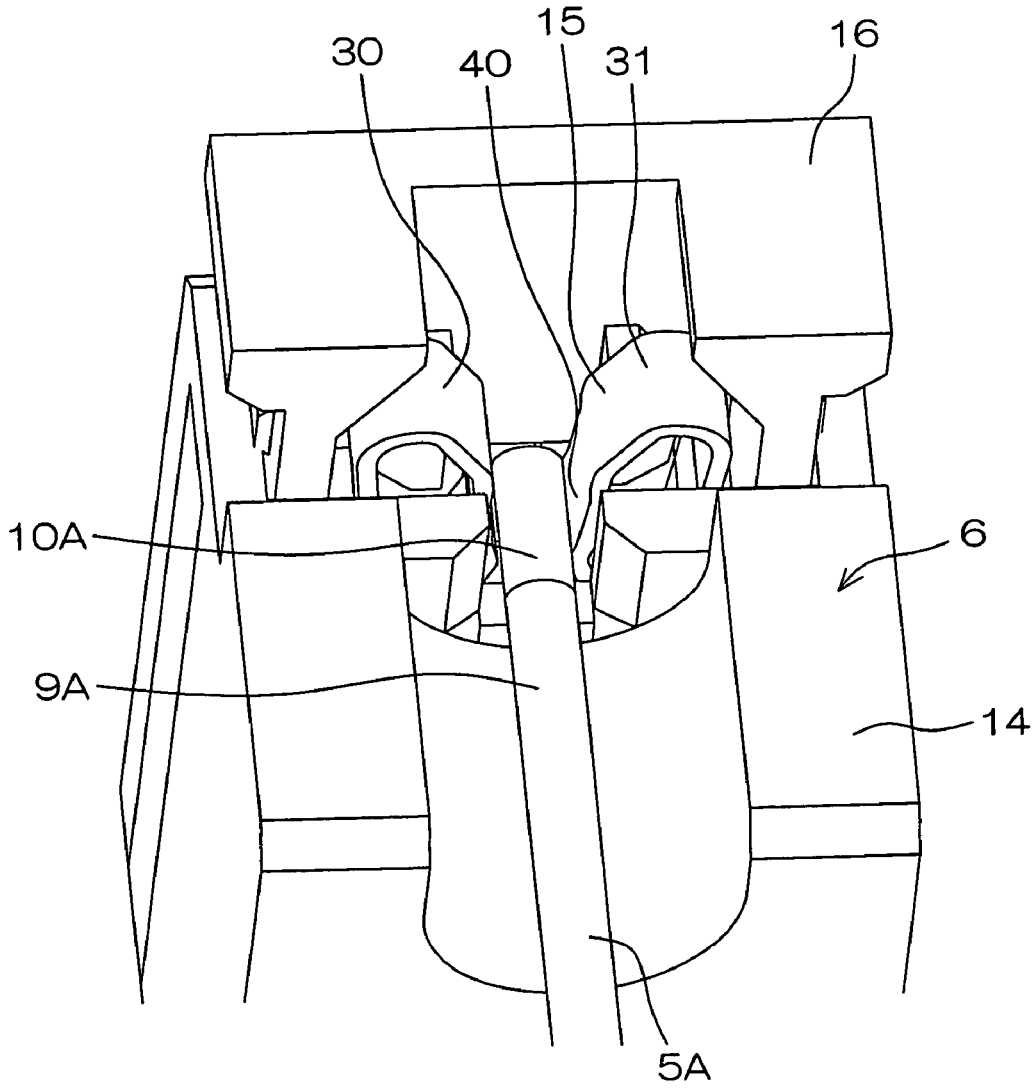
FIG. 13 is a perspective view of a main part of a fluorescent tube attaching structure according to another embodiment of the present invention.

For example, an external electrode fluorescent tube 5A can be used instead of the cold cathode fluorescent tube 5, as shown in FIG. 13. In this case, an electrode layer 10A as a terminal is covered on the respective peripheral surfaces of a pair of end portions 9A (only one end portion 9A is shown in FIG. 13) of the external electrode fluorescent tube 5A.

In this case, the electrode layer 10A can be readily inserted between the pair of straight portions 40 with a slight force, and an excessive force can be prevented from acting on the electrode layer 10A. Therefore, the electrode layer 10A can be prevented from rubbing against and being damaged by the pair of elastic pieces 30 and 31.

The tip end portions 430 of the respective second pieces 37 can be omitted. Furthermore, inclined cam surfaces similar to the first and second inclined cam surfaces 71 and 72 of the widening operating portions 48 can be provided on the engaging portions 42. In this case, on the widening operating portions 48, surfaces straight in the Direction Z can be provided instead of the first and second inclined cam surfaces 71 and 72.

The pair of pressurizing portions 62 and the corresponding pair of pressurized portions 63 can be omitted. Furthermore, the pair of first narrowing portions 39 can be omitted, the pair of second narrowing portions 41 can be omitted, and the pair of guide portions 43 can be omitted. Either one of the pair of widening operating portions 48 can be omitted. Furthermore, inclined cam surfaces similar to the pressurizing portions 62 can be provided on the pressurized portions 63. In this case, the pressurizing portions 62 can be formed as surfaces straight in the Direction Z.

Figure 14:
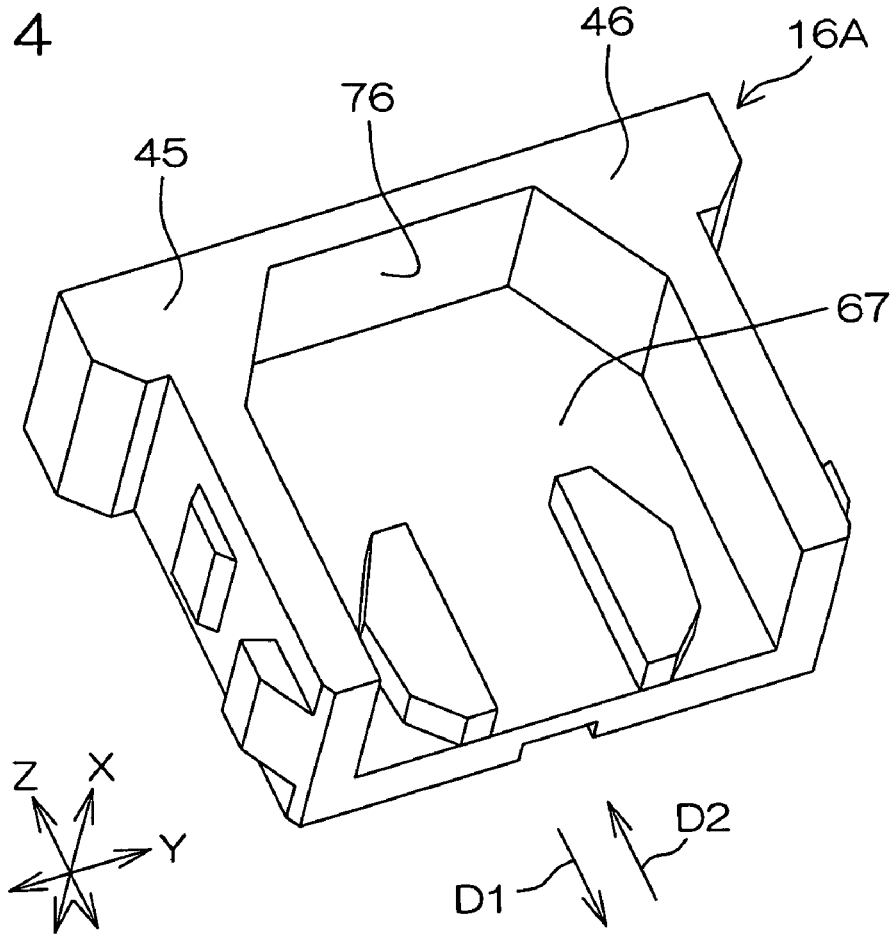
FIG. 14 is a perspective view of an operating member according to still another embodiment of the present invention.

In addition, instead of the operating member 16, a operating member 16A shown in FIG. 14 can be used. The operating member 16A has an opening preventive portion 76 that prevents the space 67 between the pair of portions 45 and 46 from opening to the second direction D2.

The opening preventive portion 76 is integrally formed with the pair of portions 45 and 46 by using a single member. This opening preventive portion 76 connects the tip end portions in the second direction D2 of the pair of portions 45 and 46 to each other. By providing the opening preventive portion 76, intrusion of foreign matter in the space 67 between the pair of portions 45 and 46 can be prevented.

By forming the section of the opening preventive portion 76 from a transparent material, the space between the pair of portions 45 and 46 can be observed from the outside. It is also possible that the opening preventive portion 76 is separately formed from the pair of portions 45 and 46 and is joined thereto via a hinge mechanism. In this case, the space between the pair of portions 45 and 46 can be observed by opening the opening preventive portion 76.

Figure 15:
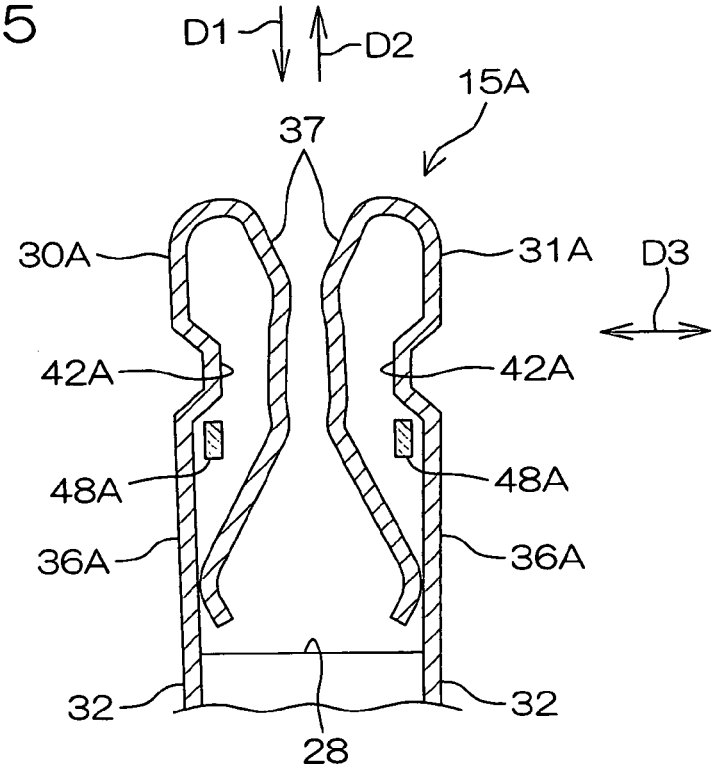
FIG. 15 is a sectional view of a main part of a fluorescent tube attaching structure according to still another embodiment of the present invention.

Furthermore, a contact 15A shown in FIG. 15 can be used instead of the contact 15. On each of the pair of elastic pieces 30A and 31A, the first piece 36A itself is provided with an engaging portion 42A. In this case, parts of middle portions of the pair of first pieces 36A swell in directions to approach each other, and these swelling portions serve as the engaging portions 42A. The widening operating portions 48A are disposed on the inner sides of the corresponding elastic pieces 30A and 31A.

Figure 16:
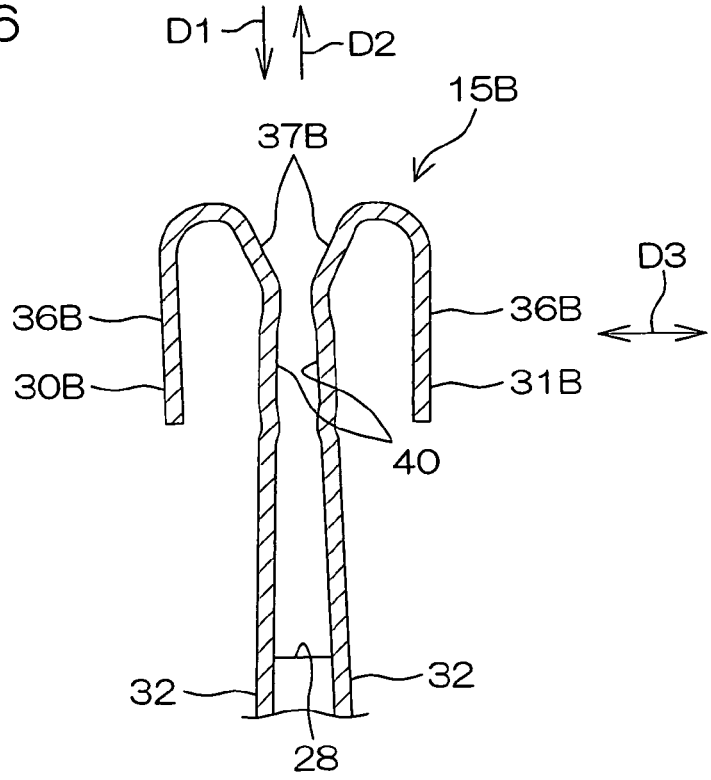
FIG. 16 is a sectional view of a main part of a contact according to still another embodiment of the present invention.

A contact 15B shown in FIG. 16 can be used instead of the contact 15. Each of the pair of elastic pieces 30B and 31B includes a second piece 37B extending along the second direction D2, and a first piece 36B that is folded back from the tip end in the second direction D2 of the second piece 37B and extends along the first direction D1. A pair of the second pieces 37B are disposed relatively close to each other, and a pair of the first pieces 36B are disposed relatively distant from each other. On the respective second pieces 37B, straight portions 40 are disposed.

Furthermore, the first restraining portion 73 can be omitted, the second restraining portion 74 can be omitted, and the third restraining portion 75 can be omitted. The number of clamping members 11 to be provided for one cold cathode fluorescent tube 5 can be two or more. Furthermore, the connector 6 can be applied to an edge light type liquid crystal display device.

It is also possible that the connector of the present invention is used for connection to a shaft-like terminal of other than the fluorescent tube. For example, it can be used for connection to a terminal of a multipole cable including a number of twisted wires. In the case of the multipole cable, the diameter of the terminal becomes thick, so that a sufficient contact pressure with the contact must be secured. Therefore, the effect of using the connector of the present invention which can secure a sufficient contact pressure and can be attached to the contact with no insertion force is significant.

The present invention is described in detail above based on a detailed embodiment, and those skilled in the art who understand the details of the description given above will readily conceive alterations, modifications, and equivalents thereof. Therefore, the scope of the present invention should be within the range of the claims and equivalents thereof.

The present application corresponds to Japanese Patent Application No. 2005-234795 submitted to the Japanese Patent Office on Aug. 12, 2005, and the entire disclosure of this application is incorporated herein by quotation.

What is claimed is:

1. A fluorescent tube attaching structure for attaching a fluorescent tube that extends in a longitudinal direction, has a pair of end portions with respect to the longitudinal direction and an intermediate portion between the pair of end portions, and is provided with a terminal on each of the end portions, comprising:

a base;

a holder which is supported by the base and holds the intermediate portion of the fluorescent tube while restraining the fluorescent tube from moving in a radial direction;

a pair of electrical connectors disposed apart from one another and connected to the base with the holder disposed therebetween;

a pair of operating members, a respective one of the pair of operating members sized for slidable connection to a respective one of the pair of electrical connectors and movable, when slidably connected to the electrical connector, to and between a full insertion position and an intermediate insertion position, each one of the pair of operating members being a rigid, unitary construction; and a pair of contacts to which the terminals of the pair of end portions of the fluorescent tube are attachable in an attaching direction corresponding to the radial direction of the fluorescent tube, a respective one of the pair of contacts supported by a respective one of the pair of electrical connectors, wherein each one of the pair of contacts includes a main body and a pair of elastic pieces, the main body having an intermediate panel and a pair of facially-opposing, spaced-apart flange panels connected to the intermediate panel to form a U-shaped configuration as viewed in cross-section with respective ones of the main bodies being fixedly connected to a respective one of the pair of electrical connectors in a stationary state, respective ones of the pair of elastic pieces facing each other and being integrally connected to and extending from respective ones of the pair of facially-opposing, spaced-apart flange panels in a cantilevered manner, the pair of elastic pieces being movable relative to the main body and towards each other from a normal, relaxed state to a flexed, clamping state and away from each other from the normal, relaxed stated to a flexed, spread-apart state, the pair of elastic pieces being resiliently biased towards the normal, relaxed state, the pair of elastic pieces have a pair of straight portions extending substantially straight in the attaching direction and facing each other, respectively, and on the pair of straight portions, a pair of contact portions for clamping the corresponding terminal of the fluorescent tube therebetween are formed, respectively, wherein, for each respective one of the pair of operating members, the pair of electrical connectors and the pair of contacts, when the operating member is moved into the intermediate insertion position, the operating member contacts the pair of elastic pieces and moves the pair of elastic pieces from the normal, relaxed state to the flexed, spread-apart state and, when the operating member is moved from the intermediate insertion position to the full insertion position, the operating member contacts the pair of elastic pieces and moves the pair of the elastic pieces from the flexed, spread-apart state through the normal, relaxed state and to the flexed, clamped state.

2. The fluorescent tube attaching structure according to claim 1, wherein each of the pair of elastic pieces includes a first piece extending in a direction opposite to the attaching direction and a second piece that is folded back from a tip end of the first piece and extends in the attaching direction, a distance between the second pieces of the pair of elastic pieces is made shorter than a distance between the first pieces of the pair of elastic pieces, and the pair of straight portions are provided on the second pieces of the pair of elastic pieces, respectively.

3. The fluorescent tube attaching structure according to claim 1, wherein the pair of elastic pieces have a pair of first narrowing portions, respectively, a distance between the pair of the first narrowing portions is made narrower than a distance between the pair of straight portions, and each of the straight portions is disposed on the attaching direction side of corresponding first narrowing portion.

4. The fluorescent tube attaching structure according to claim 3, wherein the pair of elastic pieces have a pair of second narrowing portions, respectively, a distance between the pair of second narrowing portions is made narrower than the distance between the pair of straight portions, and each of the straight portions is disposed on the direction side opposite the attaching direction of the corresponding second narrowing portion.

5. The fluorescent tube attaching structure according to claim 2, wherein the pair of second pieces have a pair of folded-back portions continued to tip ends of the first pieces, respectively, the pair of folded-back portions include a pair of guide portions for guiding the attaching of the terminal, respectively, and a distance between the pair of guide portions narrows toward the attaching direction.

6. The fluorescent tube attaching structure according to claim 1, wherein the holder is in a U-shape that forms an opening for inserting the fluorescent tube, and an opening direction of the opening is a direction opposite the attaching direction.

7. The fluorescent tube attaching structure according to claim 1, wherein the fluorescent tube includes a cold cathode fluorescent tube, and the terminal includes an outer lead exposed from the end portion of the cold cathode fluorescent tube.

8. The fluorescent tube attaching structure according to claim 1, wherein the fluorescent tube includes an external electrode fluorescent tube, and the terminal includes an electrode layer coated on a peripheral surface of an end portion of the external electrode fluorescent tube.

9. The fluorescent tube attaching structure according to claim 1, wherein the base includes a circuit board, and each of the pair of contacts is supported by a corresponding electrical connector attached to the circuit board.

10. The fluorescent tube attaching structure according to claim 9, wherein the fluorescent tube is used as a backlight facing a back face of a liquid crystal panel, and the circuit board is provided with an inverter circuit for supplying electrical power to the fluorescent tube.

11. The fluorescent tube attaching structure according to claim 10, wherein each of the pair of contacts includes a lead connected to the inverter circuit.

12. The fluorescent tube attaching structure according to claim 11, wherein the circuit board includes a first surface facing the back face of the liquid crystal panel and a second surface opposite to the first surface, and the leads are disposed along the second surface of the circuit board.

* * * * *